US007624756B1

(12) United States Patent
Coogle

(10) Patent No.: US 7,624,756 B1
(45) Date of Patent: Dec. 1, 2009

(54) REFRIGERATION CONDENSATE LINE ASSEMBLY

(76) Inventor: Gregory Coogle, 492 NW. 862 Ave., Pembroke Pines, FL (US) 33028

( * ) Notice: Subject to any disclaimer, the term of this patent is extended or adjusted under 35 U.S.C. 154(b) by 182 days.

(21) Appl. No.: 12/012,988

(22) Filed: Feb. 7, 2008

(51) Int. Cl.
*F16L 37/00* (2006.01)
*G05D 7/00* (2006.01)

(52) U.S. Cl. ..... 137/558; 137/240; 137/368; 137/271

(58) Field of Classification Search ..... 137/240, 137/368, 558, 271, 269
See application file for complete search history.

(56) References Cited

U.S. PATENT DOCUMENTS

| | | | | | |
|---|---|---|---|---|---|
| 55,638 | A | * | 6/1866 | Frink | 137/558 |
| 4,962,370 | A | * | 10/1990 | Borriello | 137/558 |
| 5,085,244 | A | * | 2/1992 | Funk | 137/240 |
| 5,402,813 | A | * | 4/1995 | Keen | 137/268 |
| 5,976,364 | A | | 11/1999 | Williams | |
| 6,041,611 | A | * | 3/2000 | Palmer | 137/240 |
| 6,068,023 | A | * | 5/2000 | Potter | 137/268 |
| 6,076,703 | A | * | 6/2000 | Kuil et al. | 222/39 |
| 6,651,690 | B1 | | 11/2003 | Coogle | |
| 6,683,535 | B1 | | 1/2004 | Utke | |
| 6,708,717 | B1 | | 3/2004 | Coogle | |
| 2006/0096638 | A1 | | 5/2006 | Coogle | |

* cited by examiner

*Primary Examiner*—Kevin L Lee
(74) *Attorney, Agent, or Firm*—Alvin S. Blum

(57) ABSTRACT

An assembly mounts between the drain pan that collects condensate water from an air conditioner and the drain line. It includes a housing with a first end connected to the pan. A second end connects to the drain line. A shut off valve shuts off the passage to the pan while maintenance is performed. A connector is mounted on the housing between the valve and the second end. It is a female member of a quick-connect coupling. A male member of the coupling may be plugged in with a single motion to seal it in place. Male members have different terminations, including a barbed tube for resilient tubing, a compressed air tire valve for delivering gas, a female water hose coupling, a tapered funnel for the nozzle of vacuum/blower, and a water sensor.

7 Claims, 7 Drawing Sheets

REFRIGERATION CONDENSATE LINE ASSEMBLY

FIELD OF THE INVENTION

This invention relates generally to air conditioning apparatus and more particularly to apparatus for maintenance of the water line that drains water from a pan that receives water that condenses on the evaporator coils of an air conditioning system.

BACKGROUND OF THE INVENTION

It is well known in the art to provide a receptacle such as a tray or pan beneath the evaporator coils of an air conditioner to receive water that condenses from the air as it is cooled. A drain line is generally connected to a side wall of the tray to drain the condensate water as it accumulates. Because water may stand still in the system, various microorganisms may grow in the tray and drain pipe until they clog up the drainage system. When this occurs, overflowing water may cause considerable damage. Because the drainage system and tray are out of sight and may be relatively inaccessible, they may be neglected until damage occurs. Clearing obstructions in the drain line and routine maintenance of the drain line are now generally done by manually disconnecting the drain line and blowing out obstructions and/or applying biocidal fluids. The drain line is then reconnected. A less labor intensive and convenient system would encourage routine maintenance and avoid complete blockage.

SUMMARY OF THE INVENTION

It is accordingly an object of the invention to provide an assembly that mounts between the drain pan and the drain line that has a variety of attachments for monitoring and cleaning the drain line to facilitate maintenance. The assembly includes a housing with an internal passage between its two ends. A first end is connected to the water outlet from the pan that receives condensate water from the evaporator. A second end is connected to the drain line so that water from the condensate pan flows through the internal passage. A shut off valve is provided adjacent the first end to shut off the passage to the pan while maintenance is performed on the drain line. A connector is mounted on an uppermost portion of the housing between the shut off valve and the second end. This connector is in fluid communication with the internal passage. It is a female member of a quick-connect coupling. A receptacle may be supplied in the housing directly below the female connector that is in fluid communication with the passage. It is designed to receive biocidal pellets through the connector. These pellets are designed to slowly release biocidal materials into the water to retard the formation of microorganisms that contribute to clogging the drain line. A male member of the coupling may be plugged in with a single motion to seal it in place. The male member is easily removed by pulling a ring back to unseal it. It is then simply lifted off. A plurality of male members are provided to perform a variety of functions. Each male member has one end with the quick-connect coupling function. The male members may be supplied with different terminations, including the following:

1. A barbed tube for connection to a resilient tubing that may supply fluid such as air or liquid to dislodge and/or wash away an obstruction or flush the drain line after the shut off valve is closed;

2. A compressed air tire valve for delivering compressed gas;

3. A female water hose coupling;

4. A tapered funnel adapted to receive the nozzle of a wet vacuum/blower hose;

5. A sealing plug; and

6. A two-electrode water sensor that can activate a signal when water in a plugged drain line rises enough to wet the electrodes. The elution of biocidal materials may increase the electrical conductivity of the water and thereby enhance the sensor function.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Figure 1:
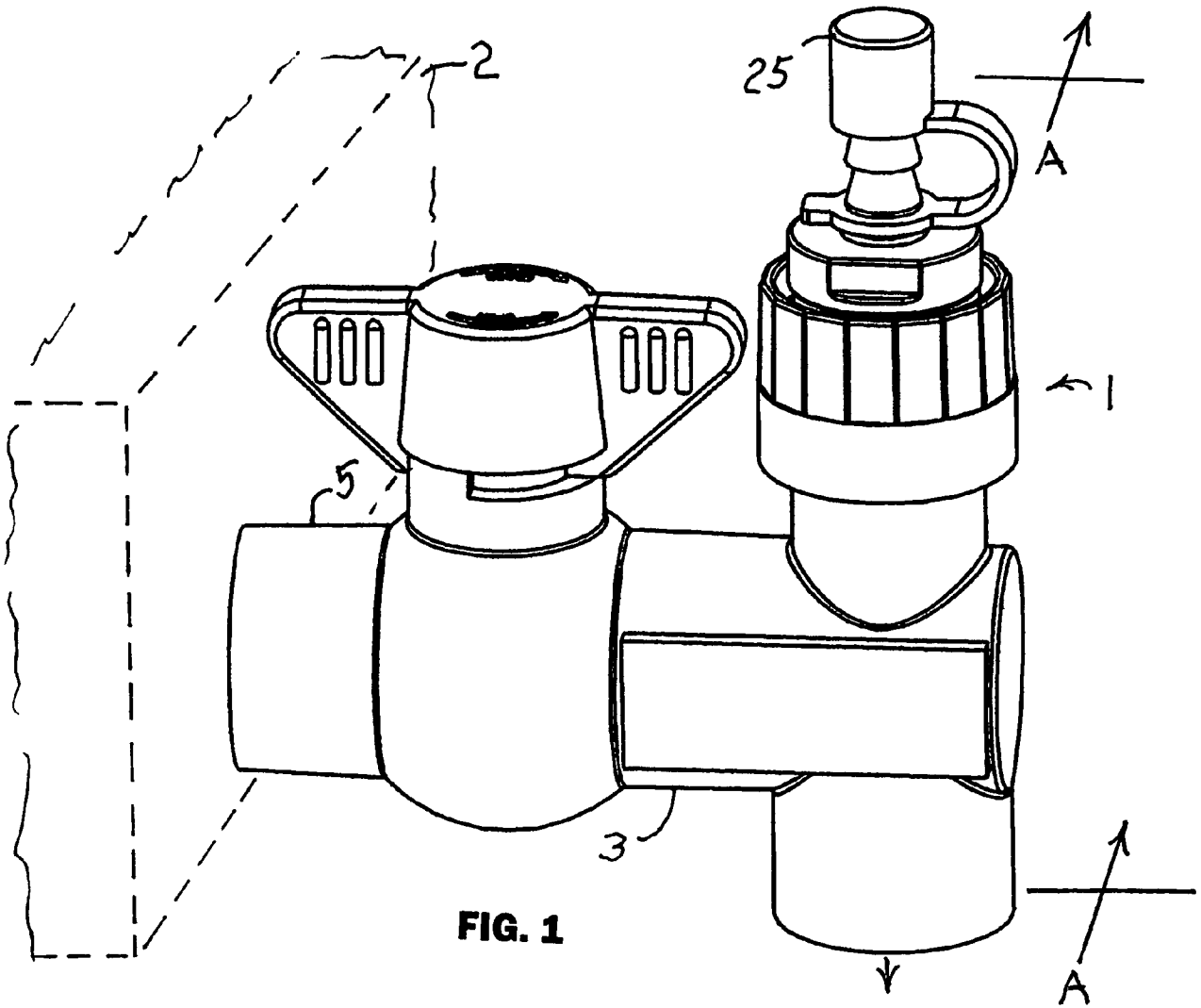
FIG. 1 is a perspective view of the assembly of the invention.

Referring now first to the drawing FIGS. 1-8, an assembly 1 of the invention includes a housing 3 that has an internal passage 4 with a first end 5 having a first end connector 7 for sealingly connecting to the vertical wall of a condensate pan 2 (shown in phantom). The condensate pan is the type located beneath the coils of a refrigeration evaporator such as found in air conditioning apparatus. Water in air passing over the cooling coils condenses out of the air as it cools. That water condenses on the coils and drips down and collects in the pan. Water in the pan is continuously drained to the outside through a drain pipe 24 (shown in phantom). Debris, often due to microorganism growth, may clog up the drain line. That may cause the drain pan to overflow, causing water damage. Cleaning a clogged drain line may be labor intensive and costly, in addition to the water overflow damage.

Figure 2:
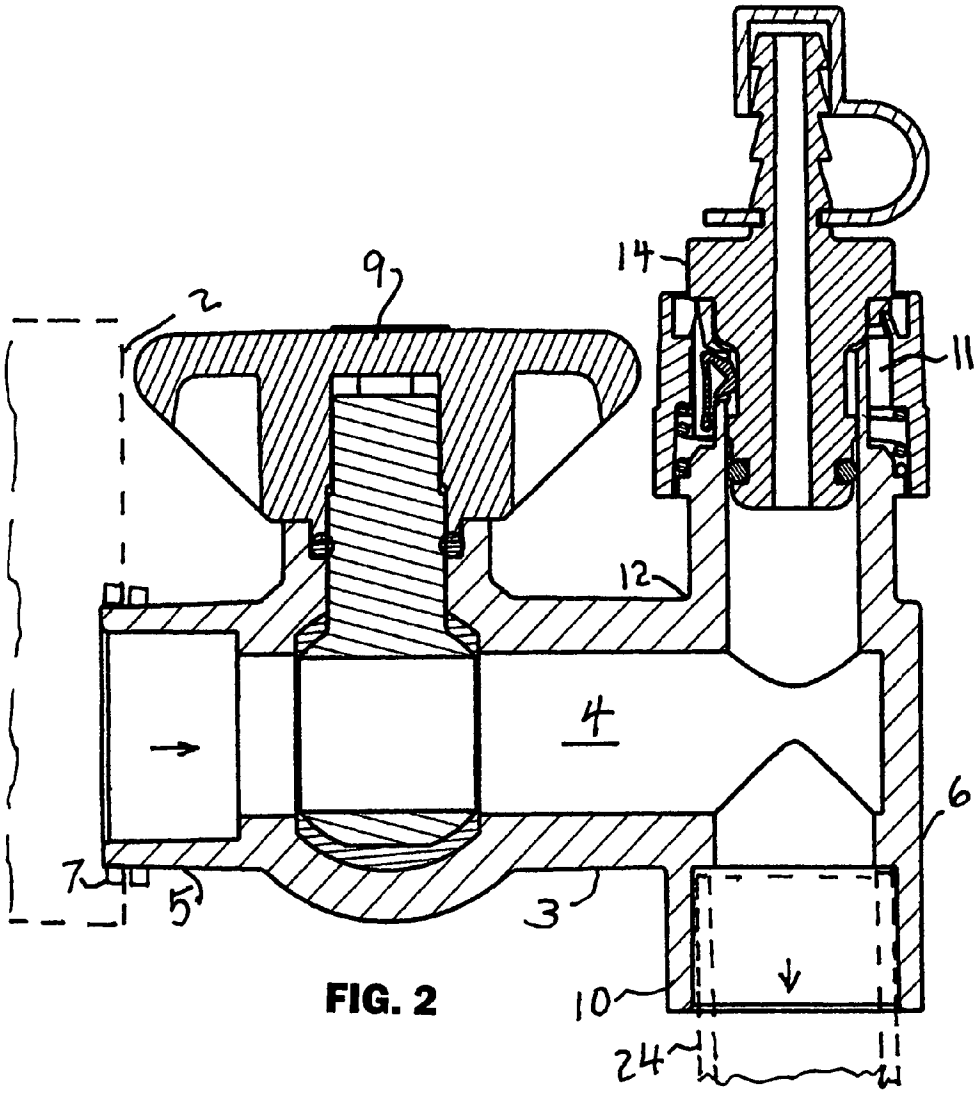
FIG. 2 is a sectional view through line A-A of FIG. 1.
Figure 7:
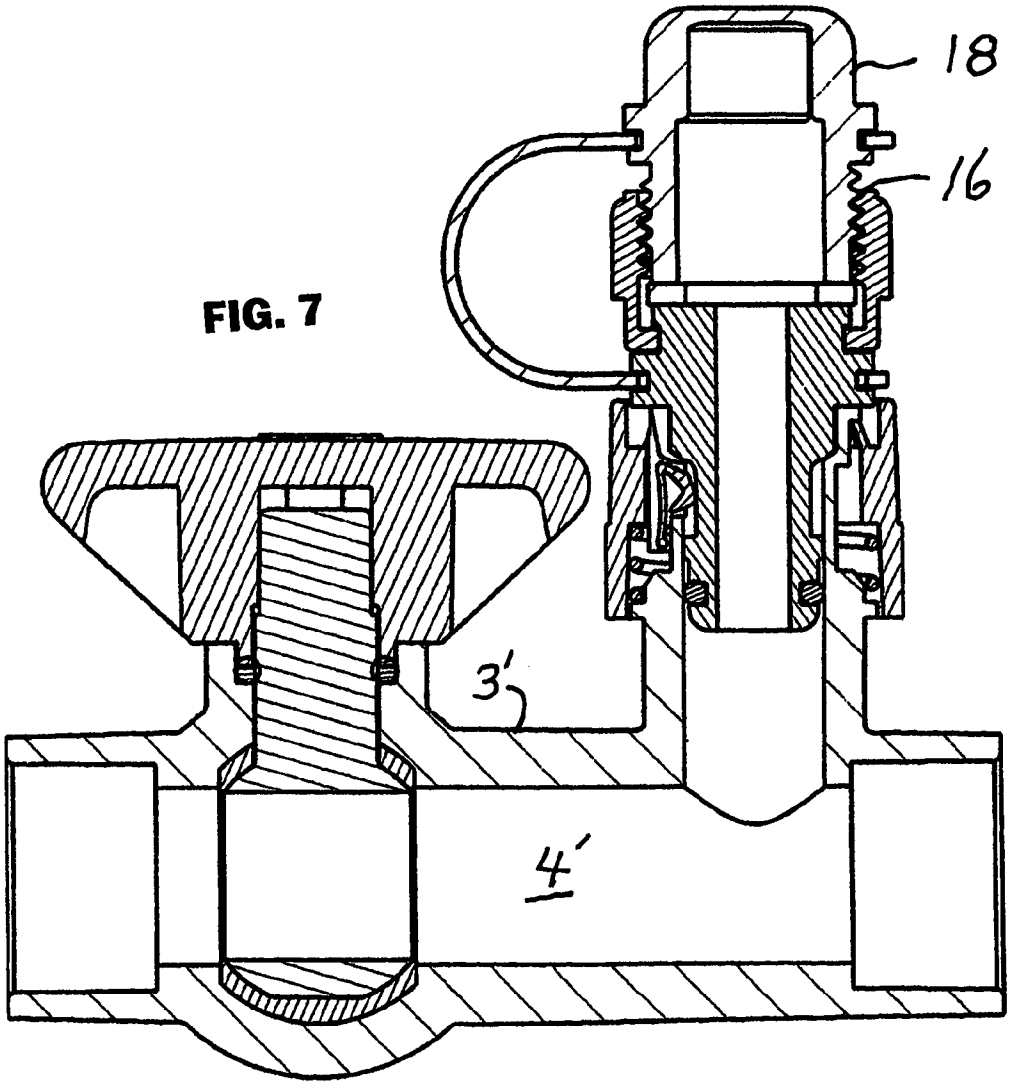
FIG. 7 is a sectional view of another embodiment with a water hose coupling in place.

The assembly 1 of the invention is introduced in the drainage system by interposing it between the pan 2 and the drain pipe 24. Second connector 10 at the second end 6 of the housing is connected to the drain pipe 24. As shown in FIG. 2, the passage 4 makes a 90 degree turn to the drain. In some plumbing situations, the passage may be straight as shown in FIG. 7, or other shape, not shown, may be employed This assembly facilitates routine maintenance, flushing out clogs, and also provides a continuous monitor of drainage. A shut off valve 9 is provided adjacent to the first end 5 to cut off the passage to the pan while applying means such as forcing fluid to clean and/or dislodge any clogs in the drain line.

Figure 3:
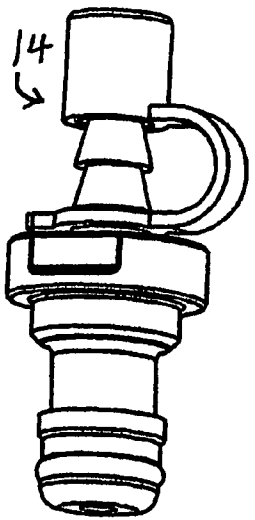
FIG. 3 is a perspective view of a male connector with barbed tube.

A third connector 11 on the upper surface 12 of the housing is in fluid communication with the passage. It is a female member of a quick-connect coupling and is positioned between the valve and the second end 6. These quick-connect couplings are well known in the art. They may be obtained from a number of sources such as Melnor Quick-connects from ACE hardware. They enable a quick and positive seal of any one of a number of male members to the coupling. As shown in FIGS. 1-3, a male member in the form of a barbed tube termination 14 may be provided. This enables the sealing of a resilient tube to the assembly that may carry a cleaning liquid or gas to blow out or flush out the line after closing valve 9. A tethered sealing cap 25 may also be provided.

Figure 4:
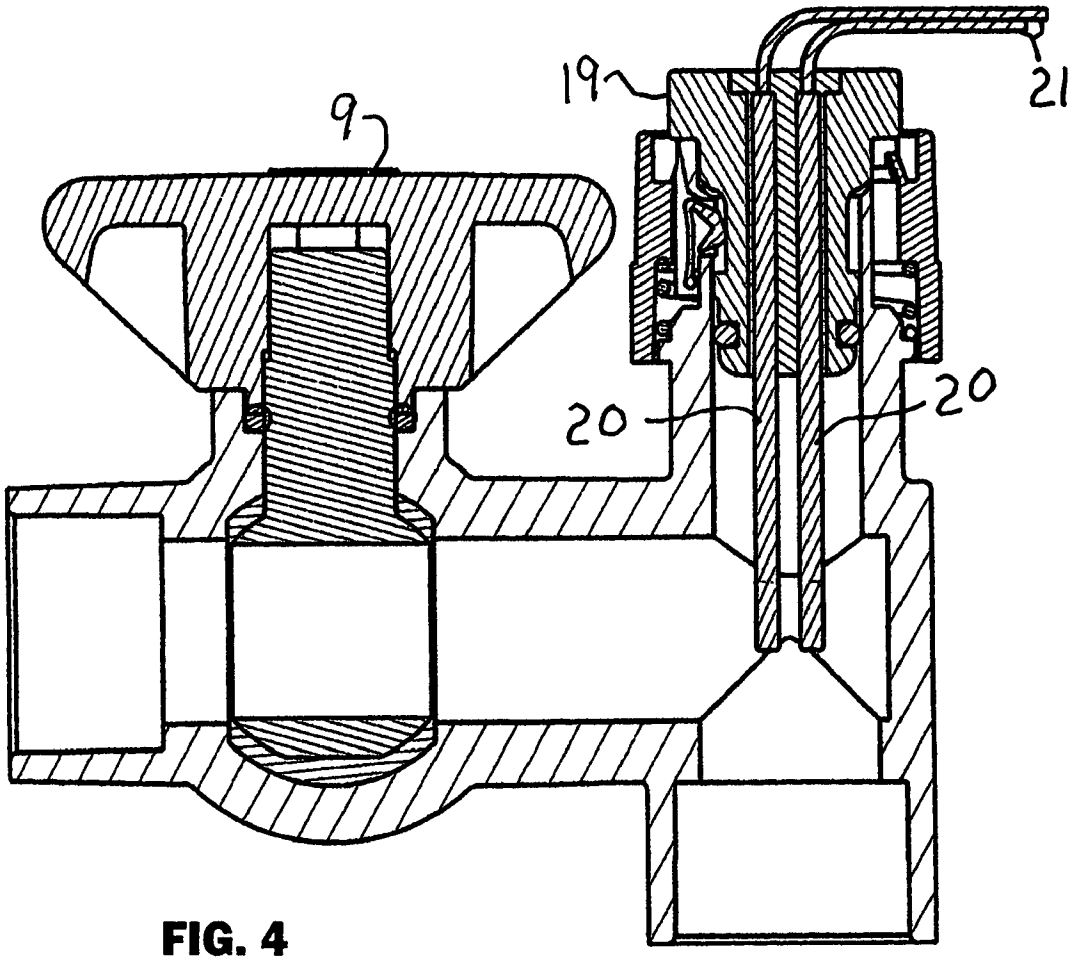
FIG. 4 is a sectional view as in FIG. 2 with a water sensor in place.

FIG. 4 shows the use of a two-electrode water sensor 19 as the male member of the coupling. It is left in place after the line is clear and the valve 9 is opened. If at any time the line should clog, the water will rise in the passage and come into contact with the two electrodes 20. The wires 21 are connected to a voltage, a current detector, and an alarm (not shown). When the two electrodes are immersed, any ions in the water will cause a current to flow between the two electrodes. The current detector will detect the flow of current and actuate the alarm, audible and/or visible to signal that the line is clogged, before any overflow and damage has occurred.

Figure 5:
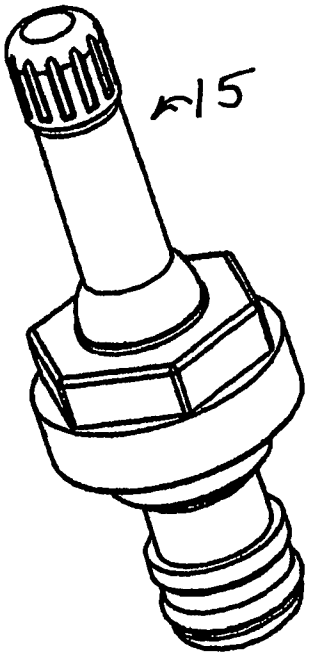
FIG. 5 is a perspective view of a male connector with tire valve.

FIG. 5 shows a compressed air tire valve male member 15 of the coupling. A compressed gas tank fitted with the hose and end fitting for filling tires may be used to blow out any clog using this device.

Figure 6:
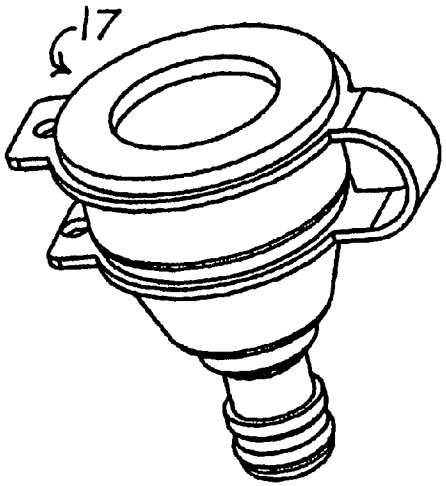
FIG. 6 is a perspective view of a male connector with tapered funnel.

FIG. 6 shows a tapered funnel male member 17 of the coupling. This will conveniently receive the tapered free end of the hose from a wet vacuum/blower machine. This may be used to alternatively suck or blow out the drain line.

FIG. 7 shows a housing 3' with a straight through internal passage 4' and a threaded female water hose male member 16 of the coupling with a sealing plug 18 screwed in where a male connector on the end of a garden hose would be received to flush out a clog.

Figure 8:
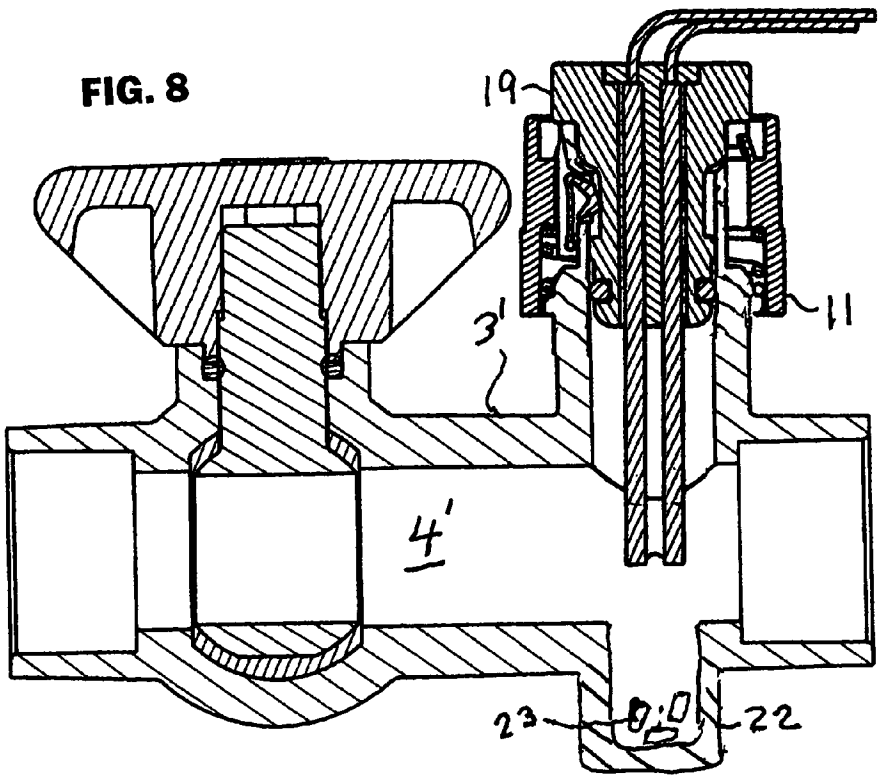
FIG. 8 is a sectional view of another embodiment with a water sensor in place.

FIG. 8 shows a housing 3' with a straight through internal passage 4' and a two-electrode male member 19 of the coupling. A receptacle 22 in the housing 3' is directly below the third connector 11 so that slowly dissolving biocidal materials 23 may be deposited through the connector 11. Since water from the pan will have very few conductive ions, any ions that elute from the materials 23 will facilitate water level detection.

Figure 9:
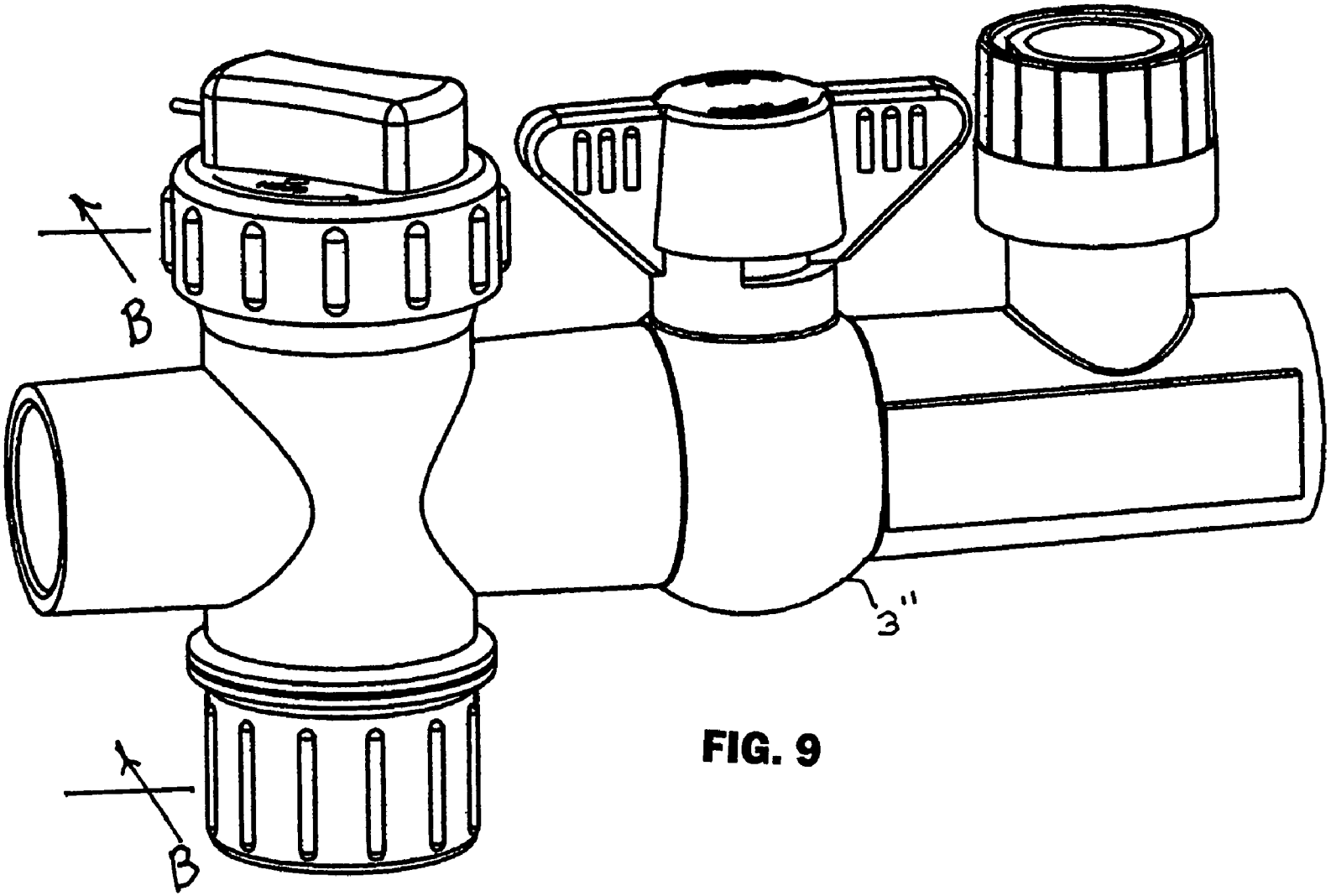
FIG. 9 is a perspective view of another embodiment with a water sensor in place.
Figure 10:
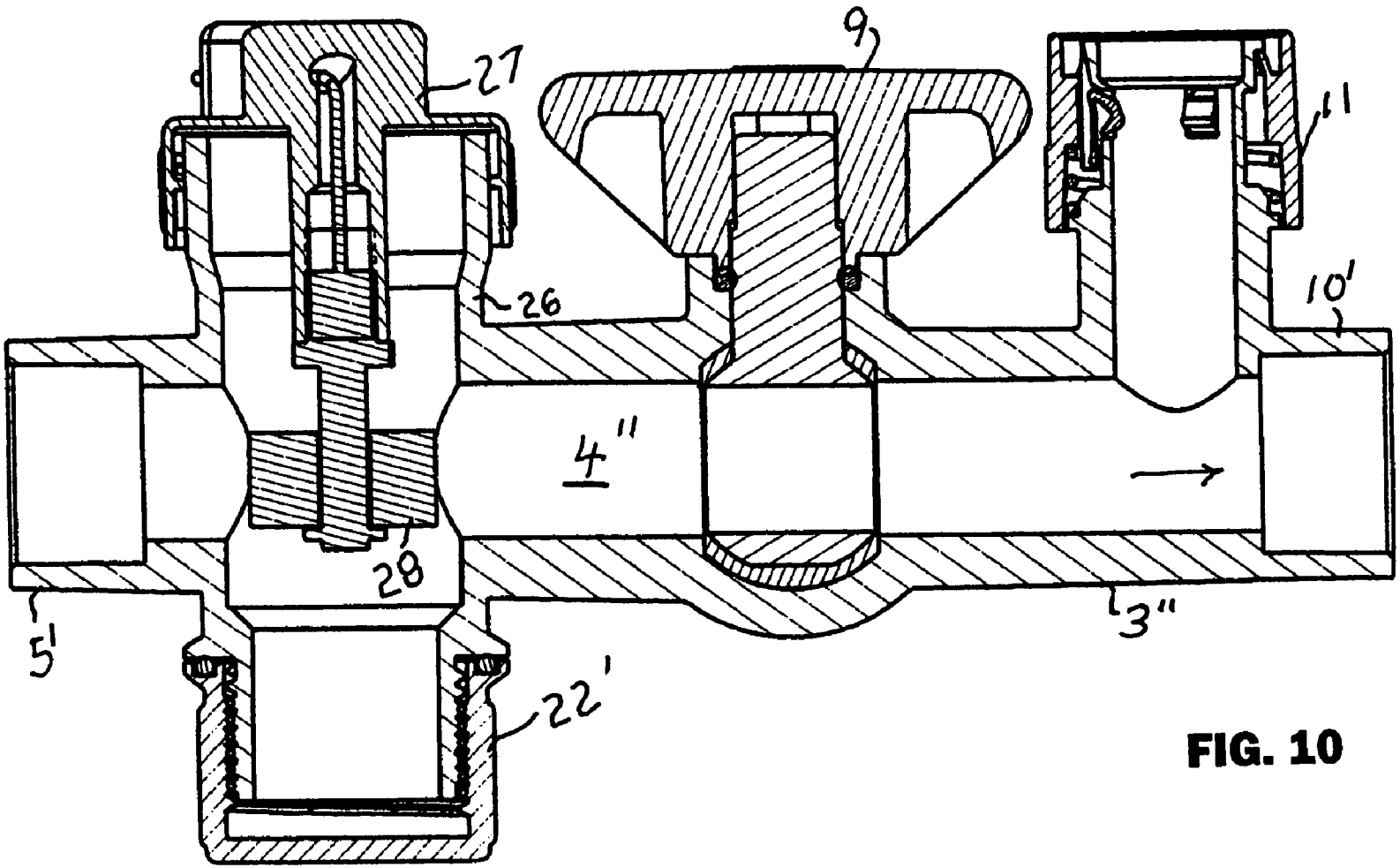
FIG. 10 is a sectional view through line B-B of FIG. 9.

Referring now to FIGS. 9 and 10, another embodiment of the invention is shown. The housing 3" encloses an internal passage 4" from a first end 5' to a second end 10'. A valve 9 and third connector 11 that is a female end of a quick-connect coupling is as above. This embodiment includes a fourth connector 26 in fluid communication with the internal passage. A water level sensor 27 in the form of a float switch with a floating magnet 28 is sealingly received in the connector 26. A receptacle 22' may be provided directly below the connector 26 to enable the passage of biocidal material into the recess through the connector. The construction enables the water level sensor to remain in place while performing maintenance on the drain line so there is less danger of forgetting to install a water level sensor when maintenance is completed. It also enables flushing out the drain pan though the assembly when the drain pan is inaccessible.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An assembly for facilitating maintenance of a drain line that drains condensate water from a pan beneath an evaporator, the assembly comprising:

a housing having an internal passage with a first end and a second end;

a first connector on the housing for securely connecting the internal passage at the first end to a water outlet of the pan;

a shut off valve adjacent the first end for manually closing the internal passage;

a second connector on the housing for connecting the drain line to the second end of the passage;

a third connector in fluid connection with the passage, the third connector mounted on an upper surface of the housing positioned intermediate the valve and the second connector, the third connector being a female member of a quick-connect coupling; and a plurality of male member connectors of the quick-connect coupling compatible with the female member, the male member connectors having terminations selected from the group of terminations consisting of a barbed tube for a resilient hose, a compressed air tire valve, a threaded female water hose coupling, a tapered funnel adapted for receiving a hose from a wet vacuum/blower, a sealing plug, and a two-electrode water sensor.

2. The assembly according to claim 1 further comprising a receptacle in the housing in fluid communication with the passage positioned directly below the third connector, the receptacle constructed for receiving biocidal material deposited through the third connector.

3. The assembly according to claim 1 further comprising a fourth connector in fluid communication with the internal passage, the fourth connector mounted on an upper surface of the housing between the first connector and the valve, the fourth connector having sealingly connected therein a water level sensor.

4. The assembly according to claim 3 in which the water level sensor includes a magnet.

5. The assembly according to claim 3 further comprising a receptacle in the housing in fluid communication with the passage positioned directly below the fourth connector, the receptacle constructed for receiving biocidal material deposited through the fourth connector.

6. An assembly for facilitating maintenance of a drain line that drains condensate water from a pan beneath an evaporator, the assembly comprising:

a housing having an internal passage with a first end and a second end;

a first connector on the housing for securely connecting the internal passage at the first end to a water outlet of the pan;

a shut off valve adjacent the first end for manually closing the internal passage;

a second connector on the housing for connecting the drain line to the second end of the passage;

a third connector in fluid communication with the passage, the third connector mounted on an upper surface of the housing positioned intermediate the valve and the second connector, the third connector being a female member of a quick-connect coupling;

a reptacle in the housing in fluid communication with the passage positioned directly below the third connector constructed for receiving biocidal material deposited through the third connector; and a plurality of male member connectors of the quick-connect coupling compatible with the female member, the male member connectors having terminations selected from the group of terminations consisting of a barbed tube for a resilient hose, a compressed air tire valve, a threaded female water hose coupling, a tapered funnel adapted for a hose from a wet vacuum/blower, a sealing plug, and a water sensor.

7. An assembly for facilitating maintenance of a drain line that drains condensate water from a pan beneath an evaporator, the assembly comprising:

a housing having an internal passage with a first end and a second end;

a first connector on the housing for securely connecting the internal passage at the first end to a water outlet of the pan;

a shut off valve adjacent the first end for manually closing the internal passage;

a second connector on the housing for connecting the drain line to the second end of the passage;

a third connector in fluid communication with the passage, the third connector mounted on an upper surface of the housing positioned intermediate the valve and the second connector, the third connector being a female member of a quick-connect coupling;

a receptacle in the housing in fluid communication with the passage positioned directly below the third connector constructed for receiving biocidal material deposited through the third connector; and a plurality of male member connectors of the quick-connect coupling compatible with the female member, the male member connectors having at least four different terminations selected from the group of terminations consisting of a barbed tube for a resilient hose, a compressed air tire valve, a threaded female water hose coupling, a tapered funnel adapted for a hose from a wet vacuum/blower, a sealing plug, and a two-electrode water sensor.

* * * * *